US005720561A

United States Patent [19]

Ryan et al.

[11] Patent Number: 5,720,561

[45] Date of Patent: Feb. 24, 1998

[54] PRINTER COIL TEMPERATURE SENSOR AND METHOD

[75] Inventors: Robert P. Ryan, Mission Viejo; Gordon B. Barrus, San Juan Capistrano; Tiet Pham, Irvine, all of Calif.

[73] Assignee: Printronix, Inc., Irvine, Calif.

[21] Appl. No.: 558,152

[22] Filed: Nov. 15, 1995

[51] Int. Cl.[6] ..... B41J 2/30

[52] U.S. Cl. ..... 400/124.13; 400/157.2; 101/93.03

[58] Field of Search ..... 400/124.03, 124.07, 400/124.13, 120.11, 54, 74, 157.2, 157.3, 166, 323, 341; 101/93.03, 93.04, 93.05

[56] References Cited

U.S. PATENT DOCUMENTS

| | | | |
|---|---|---|---|
| 4,359,289 | 11/1982 | Barrus | 400/341 |
| 4,540,295 | 9/1985 | Okunishi | 400/323 |
| 4,705,412 | 11/1987 | Matsumoto | 101/93.04 |
| 4,724,336 | 2/1988 | Ichikawa et al. | 101/93.04 |
| 5,241,904 | 9/1993 | Kobayashi et al. | 101/93.04 |

FOREIGN PATENT DOCUMENTS

| | | | |
|---|---|---|---|
| 4005058 | 1/1992 | Japan | 400/124 TC |

*Primary Examiner*—Edgar S. Burr
*Assistant Examiner*—Steven S. Kelley
*Attorney, Agent, or Firm*—George F. Bethel; Patience K. Bethel

[57] ABSTRACT

A line printer having a hammerbank with hammers that are held by a permanent magnet and released by electrically driven coils. The temperature of the coils is determined by the relative resistance of the coils to provide an output equivalent to the temperature of said coils. The resistance is determined as a function of the current through the coils or voltage of the coils which is converted from an analog to a digital value. The attendant method of determining temperature of the coils in the hammerbank is by comparing a pre-established current or voltage value based upon a pre-established temperature of the coil with the current passing through the coil during operation of the hammerbank. The comparison of the current passing through the coil during operation with the pre-established current is provided to a controller for controlling the printer in response to the current differential between the currents which is in turn a function of the operating temperature.

19 Claims, 4 Drawing Sheets

PRINTER COIL TEMPERATURE SENSOR AND METHOD

BACKGROUND OF THE INVENTION

1. Field of the Invention

The field of this invention lies within the printer art as it relates to certain dot matrix printers. More particularly, it lies within the art of line printers wherein a series of hammers are retained by magnetic force until released. The release is accomplished by coils in association with the magnetic retention means that create a nullifying or opposite magnetic force for releasing the hammers. These coils are driven by a number of electronic drivers. The coils are subject to temperature variations depending upon the duty cycle of the printer.

2. Prior Art

The prior art with regard to dot matrix printers and in particular line matrix printers provides for magnetic retention of a series of hammers with printer tips. The magnetic retention is by means of a magnet, and associated pole pieces which in many cases can be 2 pole pieces that retain the hammer in close juxtaposition or in contact therewith. The pole pieces are magnetically oriented so as to allow the magnetic lines of flux from the permanent magnet to pass through the hammers and retain them until release.

The release of the hammers causes an impact against a ribbon which overlies the print media upon which printing takes place.

The impact printers of the foregoing type operate over extended periods of time in many rugged environments. As previously stated they rely upon a dot matrix configuration to create alpha, numeric or other print forms such as bar codes. The creation of dots to form a dot matrix for various high density applications such as bar code printing creates a substantial load on the printer.

During the process of increasing the rate of dot matrix printing, the hammers must be fired with increasing rapidity. Increasing rapidity causes the coils to attendantly be energized in greater numbers or sequences during a given time frame.

The power requirements for the coils to release the hammers in greater numbers of sequences is such wherein the larger amounts of power increase the heat of the coils. As a consequence, the increased number of power sequences for more rapid firing of the hammers increases the heat in the coils which can cause attendant coil failure.

It should be understood that the coils are encapsulated in a very closed environment. Oftentimes, they are potted into the hammerbank or sealed. Although, the hammerbank can provide a heat sink by virtue of its structure, nevertheless, heating of the coils takes place to a greater degree due to increased printing requirements as to both speed and density.

Coil overheating causes failure of the printer or in the alternative improper reaction time upon the part of the print hammers. The overheating or increased heating has never been sensed on a basis which could improve the overall function of line printers to the extent of this invention.

This invention is directed toward preventing thermal damage to the hammerbank coils as well as providing increased rates of printing and greater overall performance. The end result, including decreased thermal damage to the hammerbank coils is accomplished by hardware and a method which will be detailed hereinafter in the form of the apparatus, and method descriptions.

The basis of the sensor and method hereof is to detect temperature by determining the resistance of the coil which is related to the current passing therethrough. Fundamentally, the measured change in current through, or voltage pertaining to any given coil can equate to the change in temperature.

The change in coil temperature is measured during each reciprocation or turnaround period of the shuttle holding the hammerbank. In making the measurement, the detection determines coil temperature with respect to an initial calibration temperature. If it is warm compared to the initial calibrated temperature, the printer will only print in a single direction and not in the reciprocal mode until the respective coil has cooled. If detection of a hot coil is determined with respect to the initially calibrated temperature, printing is stopped. During the stopping of the printing, no data is lost and the operator may clear the fault of the overheating and continue.

In order to provide for proper calibration, each printer when either initially started or repaired is newly calibrated. This calibration is through a menu such that calibration takes place at approximately room temperature of 20° to 25° centigrade.

The invention relies upon coil temperature readings based upon a change in the resistance of the coils due to temperature change. This method in the manner as set forth hereinafter is not known in the art of line printers. It is a significant improvement over the sensing and operation of line printers for consistency, prevention of coil failures, and proper operating conditions. This is particularly true under the required conditions in which line printers are now operated for heavy density printing including bar code printing and other related high speed printing requirements.

SUMMARY OF THE INVENTION

In summation, this invention comprises a line printer having a series of hammers in a hammerbank which are driven by electronic drivers connected to coils, the temperature of which is sensed by the respective current through the coils or voltage pertaining thereto.

More particularly, the invention comprises an impact printer of the line printer type. The impact printer of the line printer type has a series of hammers that are connected to a hammerbank. Each hammer is retained by a permanent magnet and released by overcoming the permanent magnetism through an associated coil reversing the magnetic field.

In order to reverse or nullify the magnetic field, the coils are driven by an electronic driver. The electronic driver provides current to the coils in a manner such that a heating factor is encountered. This heating factor is such wherein it can damage the coils if the temperature increases beyond a certain amount. In order to prevent the temperature of the coils from rising beyond a certain prescribed temperature, the coil temperature is read based upon changes in resistance.

The resistance is based upon the amount of current through a coil and/or the associated voltage during a certain period. The change in the current through a given coil and/or associated voltage is measured during turnaround of the shuttle with the hammerbank. Only one coil is measured at the time of each turnaround period of the hammerbank. This coil temperature is compared to an initially calibrated temperature and if it is within the norm, the next coil in the series is measured at the next turnaround as to the current flowing through the next coil.

In the event the temperature that is detected of a particular coil is relatively warm, the printer will only print thereafter in a unidirectional manner until the coil has cooled. If the temperature of a particular coil is determined as being hot, the printer will then go into a fault mode and stop printing until the relative temperature of that coil cools. At the time of the stopping of the printer, all data is retained and printing can continue with the respective data thereafter.

As a consequence of the foregoing determination of coil temperature, there is provided an improved and substantially enhanced temperature reading of coils for greater durability of the attendant coils and hammerbank, greater accuracy, increased durability and longevity of the printer, and increased speeds of printing due to greater speeds of firing of the print hammers based upon increased sequences of energizing the coils for firing purposes.

DESCRIPTION OF THE PREFERRED EMBODIMENTS

Figure 1:
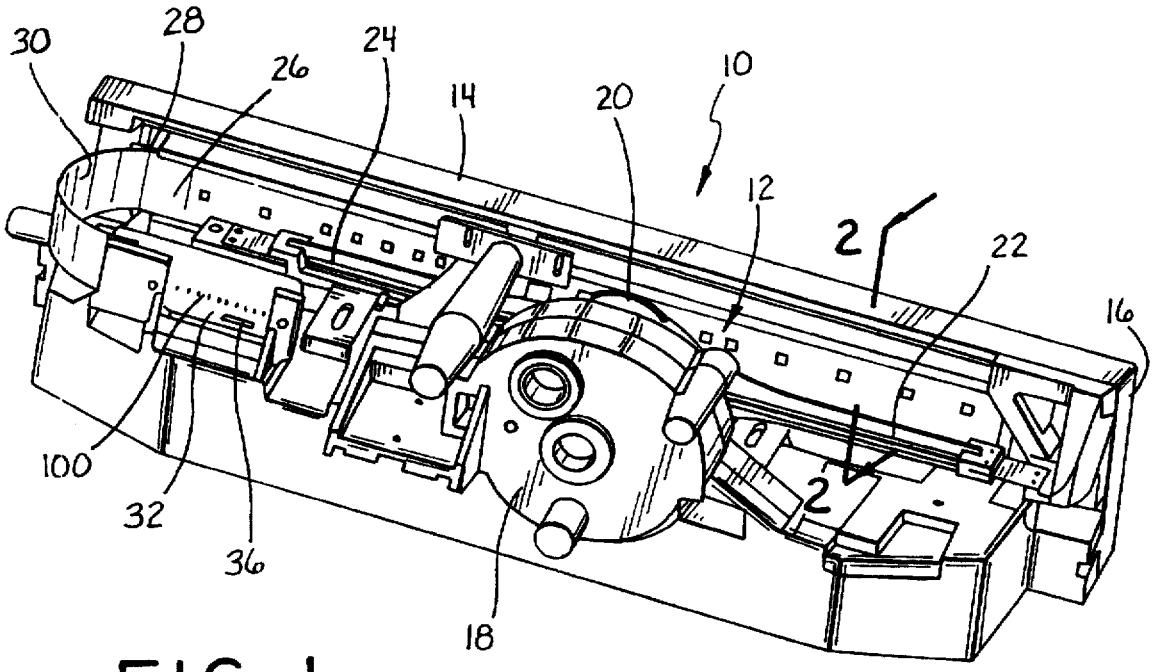
FIG. 1 shows a perspective view of a printer hammerbank and shuttle drive of this invention.

Looking more particularly at FIG. 1, it can be seen wherein a shuttle frame assembly (shuttle) 10 is shown. The shuttle frame assembly 10 includes a hammerbank assembly 12, which is shown covered in part, as well as a counterweight assembly 14. The counterweight assembly 14 is supported on leaf springs at either end, one of which, namely leaf spring 16 is shown. The counterweight assembly 14 serves to balance the movement of the hammerbank assembly as it is driven.

A shuttle motor 18 is shown. The shuttle motor 18 has a number of teeth at its outer circumference 20. These teeth are used for electrical impulse timing purposes in order to time the operation of the entire printer based upon shuttle motor 18 movement. The movement of the shuttle 10 is timed with the respective firing of the hammers and the driver movement by the shuttle motor 18.

The hammerbank and counterweight assemblies 12 and 14 are driven by the motor 18 by means of two reciprocating drive rods 22 and 24.

On the back of the hammerbank assembly 12 is a circuit board 26 which is connected by a cable connection 28 to a flexible cable 30 having a number of lines which terminate at a terminator board 32. The terminator board 32 provides a number of pins 34 for power as well as pins 36 for providing logic to the circuit board 26.

Figure 2:
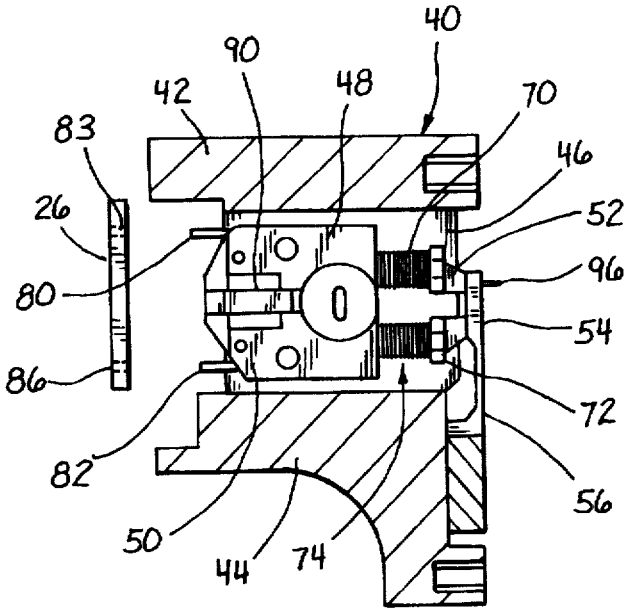
FIG. 2 shows a cross-sectional view along lines 2—2 of FIG. 1 detailing the coils, and magnetics of the hammerbank.
Figure 3:
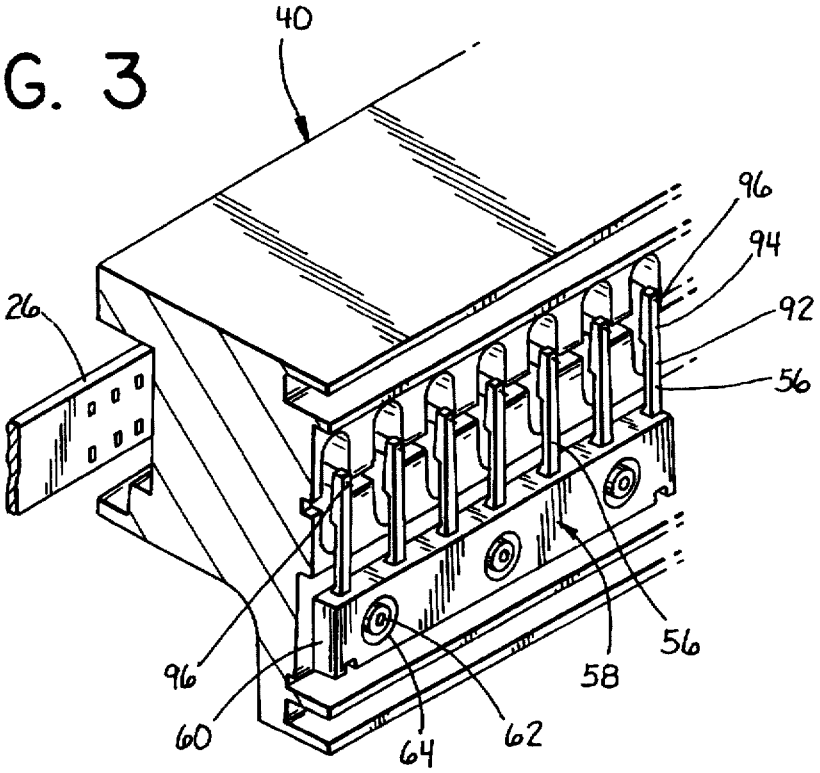
FIG. 3 shows a frontal perspective fragmented view looking toward the opposite side of the hammerbank in the direction of arrow 3 of FIG. 1.

Looking more particularly at FIGS. 2 and 3, it can be seen that the hammerbank is shown in cross-section. FIG. 2 is sectioned along lines 2—2 of FIG. 1. The sectional view of FIG. 2 shows the hammerbank casting 40 formed from an upper portion 42 and a lower portion 44. The respective upper portions 42 and lower portions 44 have a number of through holes 46 passing therethrough. The through holes 46, receive a pair of pole pieces formed as an upper pole piece 48 and a lower pole piece 50. The two pole pieces 48 and 50 terminate at ends 52 and 54.

From the foregoing including FIG. 3, it can be seen that the upper pole piece 48 and the lower pole piece 50 have their ends 52 and 54 in contacting relationship with a series of hammers 56. The hammers are formed as a series of hammers in frets of seven. The numbers of hammers 56 in a fret 58 have been practically designed to accommodate groupings of three and eleven as well as seven.

The fret 58 comprises a base portion 60 that can be secured with a screw 62 through a through hole 64 to the hammerbank casting 44.

Each of the pole pieces 48 and 50 have a coil 70 and 72 wrapped around them comprising a continuous coil or winding 74. The coils 70 and 72 are fundamentally a continuing coil and are connected to terminals which extend outwardly from the pole pieces forming circuit board connection terminals 80 and 82 passing into openings 83 and 86 of the circuit board 26.

The connection terminals 80 and 82 are connected to a driver board in the form of the circuit board 26 having drive transistors. The driver board in the form of the circuit board 26 has a plurality of openings which receive the connection terminals 80 and 82 therethrough for driving the plurality of coils 74 for release or firing of their attendant hammers.

The pole pieces are generally potted or secured in a suitable manner in the cavities 46 within the upper and lower portions 42 and 44 of the hammerbank. Between each pole piece 48 and 50 is a permanent magnet 90. The permanent magnet 90 retains the hammers 56 of the hammerbank.

Each hammer is shown having an enlarged base portion mounting which extends upwardly and tapers into a spring portion 92. The spring portion 92 terminates in an enlarged portion 94 which forms an enlarged head for purposes of receiving a pin or stylus 96 which provides the dot, for dot matrix printing.

When a voltage is applied to terminals 80 and 82, it energizes coils 70 and 72 to change the magnetic field and release or fire the hammers 56 in order for the pin or stylus 96 to strike the ribbon which prints on the print media.

In order to electrically drive the hammers 56 by causing them to be released by overcoming the permanent magnetism a number of transistors such as mosfet drivers are utilized on the circuit board 26. These are seen more clearly in FIG. 4. In this particular showing, it can be seen that the circuit board 26 has been fragmented to show only a portion of the mosfets, resistors and other circuitry. The circuitry is controlled by means of a controller board or data processor 202 for the printer through the flex cable 30 which in turn is connected directly to the hammerbank circuit board 26.

Figure 4:
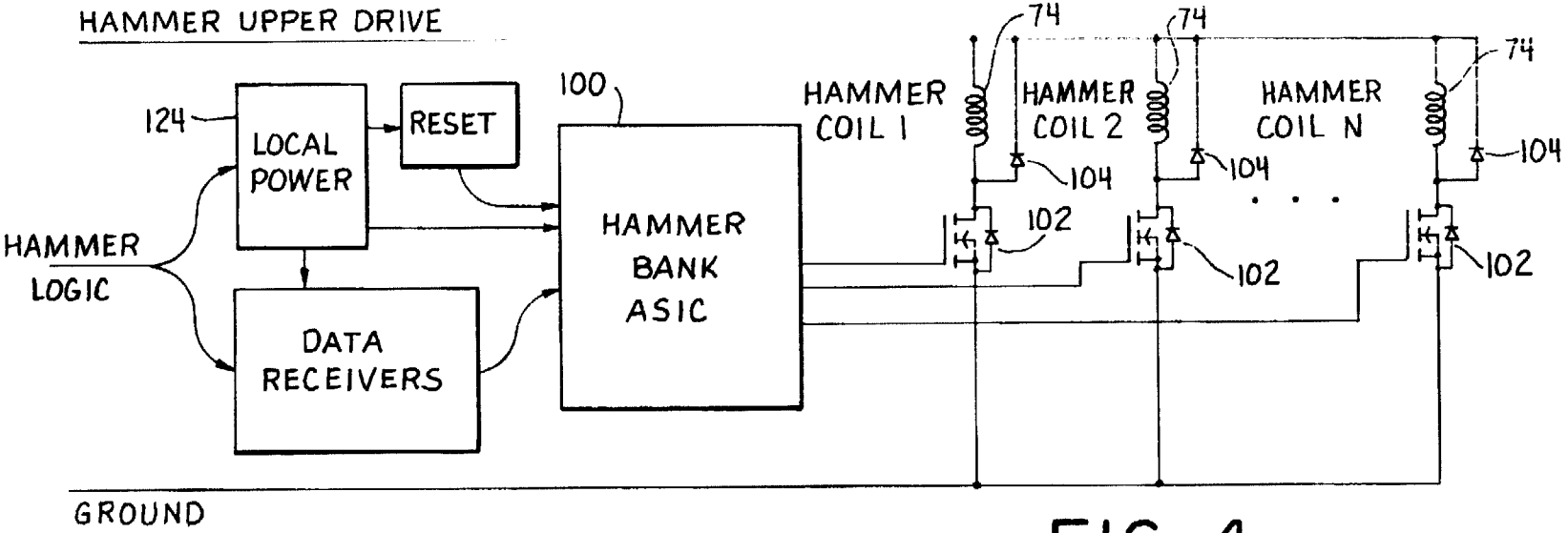
FIG. 4 shows a diagram of a portion of the integrated drive circuit of the hammerbank, for explanatory purposes.

Looking more specifically at FIG. 4, the circuit board 26 is shown with some of the functions thereof. The figure shows the hammer logic from the printer controller board or data processor 202 to the local power, reset, data receivers, and a hammerbank ASIC 100. The hammerbank coils comprising coils 74 include coil portions 70 and 72.

FIG. 4 further shows mosfets 102 for each respective coil 74 and their hammers 56. For purposes of simplicity, coils 1 through N have been shown as coils 1, 2 and coil N. Additionally, flyback diodes 104 have been shown as well as the hammer upper drive and ground.

For purposes of placing a dot on the paper or print media, the lower hammer drive mosfet 102 of the respective hammer 56 at the desired dot position is energized. Energizing the lower mosfet 102 connects the lower side of the coil to ground. At the same time, which is the proper phase fire time, the upper drive is connected through a mosfet to a 48 volt source. This completes a circuit that rapidly ramps the coil 74 current to a level necessary to cancel the permanent magnetism. Too little, or too much current will either not cancel, or create a new opposite magnetic field, preventing the hammers 56 from flying away from the pole piece ends 52 and 54.

At the time when the permanent magnetism is canceled, the hammers 56 begin to fly toward the ribbon and paper or media. The upper drive is switched from a 48V source to an 8.5V source. This voltage stops the rapid current rise and maintains a canceling effect on the magnetic field until such time as the hammer has impacted the ribbon and paper forming a dot image. At the time that the dot is formed, the lower drive including mosfets 102 is de-energized and the energy stored in the coil is returned to the upper drive through the flyback diodes 104. The permanent magnetic field is restored and the hammer 56 is drawn back to the pole pieces 52 and 54 and retained until subsequent firing or release.

A lower drive mosfet 102, flyback diode 104, and gate resistor are required for each hammer coil 74 comprising coil sections 70 and 72. As more hammers 56 are added more hammerbank ASICs 100 are required. The ASIC's inputs are tied together. Each ASIC is configured by its position on the circuit board 26. It will use only the portion of the data stream corresponding to its hammers 56. The upper drive circuit is common to a group of hammers or logic phase. The upper drivers can reside on the controller board and are connected to the upper side of the hammer coil through a few large conductors. Power on the circuit board 26 for the 5 volt power of the mosfets is supplied by a small power supply 124.

Figure 8:
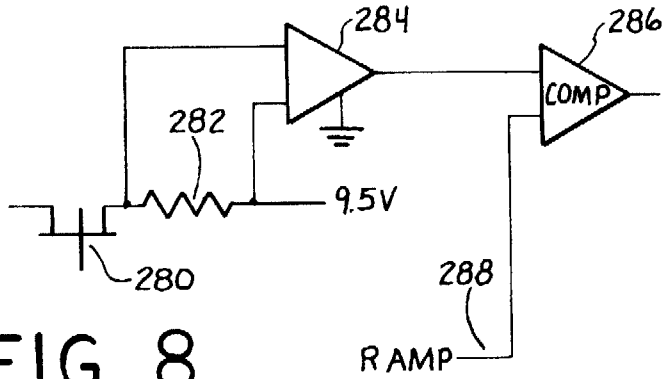
FIG. 8 shows the coil test circuit of this invention which forms a portion of the schematic/block diagram of FIG. 5.
Figures 5, 8A:
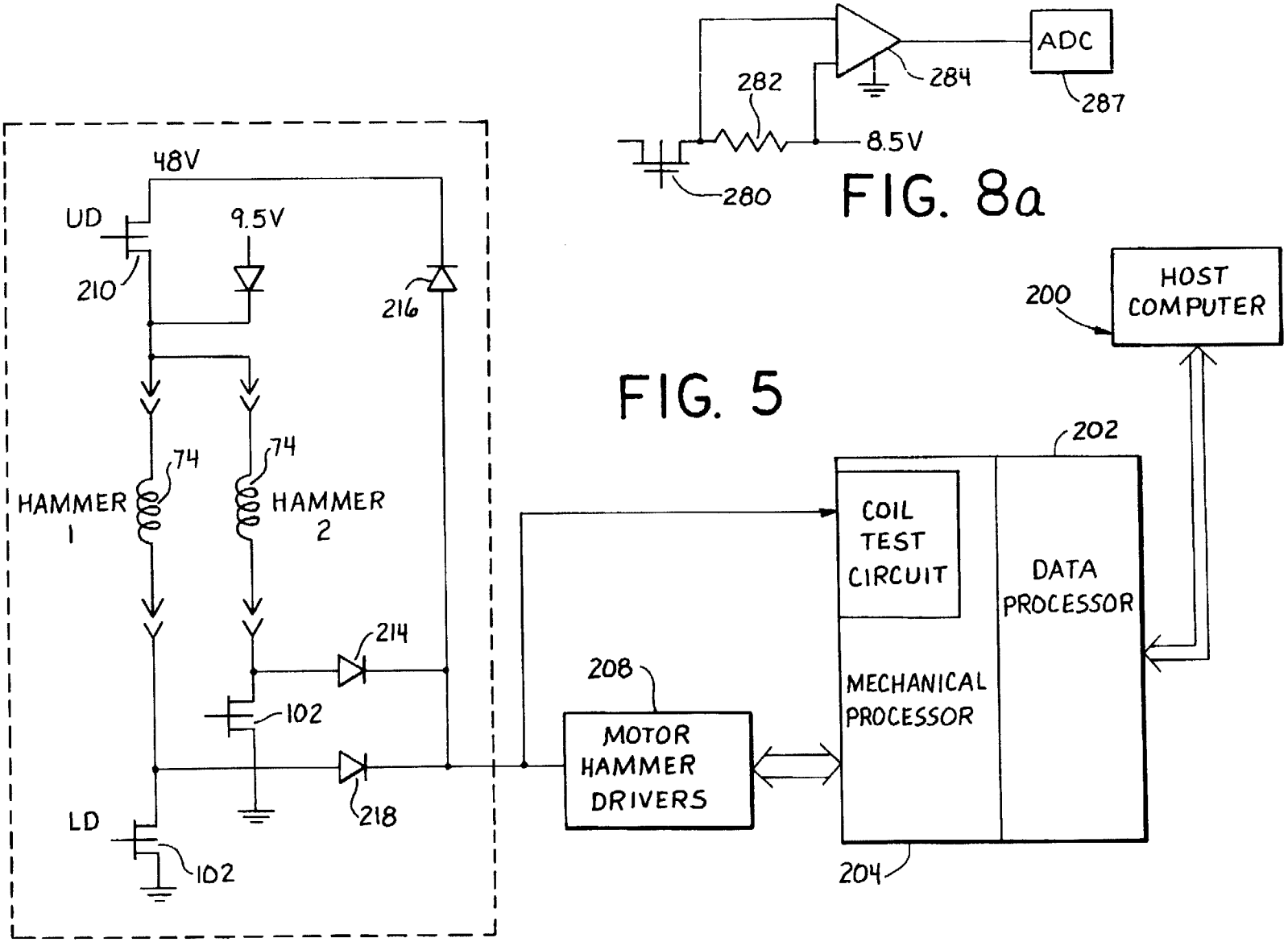
FIG. 5 shows a block diagram and schematic of the coil temperature sensor and method of this invention.
FIG. 8*a* shows an alternative test coil circuit to that of FIG. 8.

Looking more particularly at FIG. 5, it can be seen wherein a host computer 200 is shown. The host computer 200 can be any particular computer configuration having the particular data which is to be printed by the printer of this invention of which the shuttle frame assembly 10 forms a portion thereof. The host computer 200 is linked to a data processor or controller board 202 of the printer which provides the data which is to be printed by the hammers 56 of the hammerbank 12. This data processor 202 can be centrally located within the printer or it can be remotely located. In most cases, it is in association with the printer and incorporated therein.

The data processor 202 is linked to a mechanical processor 204. The mechanical processor 204 incorporates the particular mechanical drive functions and commands in order to cause the printer to print. This is in association with the printer hammerbank 12 which forms a portion of the printer. The printer hammerbank 12 is controlled by the mechanical processor 204, as well as movement of paper upwardly and downwardly, and various functions including the movement of the hammerbank 12 in its oscillatory or reciprocating back and forth movement. This takes place by the mechanical processor 204 being placed in connected relationship to the various mechanical functioning portions 208 of the printer including the various motors and hammer drivers on the circuit board 26. Mechanical functions or portions of 208 as previously stated can be such as the motor 18 which drives the shafts 22 and 24 to move the hammerbank 12 backwardly and forwardly.

The other functions controlled by the mechanical processor 204 include the paper drive, the various means for controlling overall mechanical movements associated with line printers, and the power functions related thereto.

Looking more specifically at FIG. 4 in connection with FIG. 5, it can be seen that the hammer coils of the first and second hammer are shown as coils 74. The coils 74 are the coils that are driven by an upper drive of 48 volts that has been labeled UD for upper drive. The upper drive UD comprises a mosfet 210 which serves a plurality of coils 74, including the two coils that are shown plus an additional two making a series of four. The lower drive shown as LD comprises mosfets 102 as seen in FIG. 4. These mosfets 102 are energized respectively for allowing each of the coils 74 associated with each mosfet to cause the hammers 56 to be released or fired.

In association with each mosfet 102 is a flyback diode 102. Clamping diode 216 serve the function of preventing feedback into the system.

As can be appreciated, the hammerbank assembly within the hammerbank casting 40 is such wherein the coils 74 comprising coil portions 70 and 72 can be significantly heated. This is due to the fact that during multiple high firing rates of the hammers 56, current is constantly caused to flow through them during heavy duty printing cycles. This being the case, the coils 74 can overheat significantly.

The coil test circuit of FIG. 8 tests the current seen through the coils 74 with respect to the flyback current during the operation of the hammerbank 14. Control and powering of course is through the integrated driver system as seen in FIG. 4 connected to the terminals 80 and 82 which are connected to coil portions 70 and 72 comprising coil 74.

In the particular printer in the example hereof, there are a total of 48 hammers 56 in the hammerbank 12. Numerous hammer 56 arrangements can be associated with the hammerbank on the frets 58 in a manner dependent upon the duty cycle for printing and the number of hammers printing during the duty cycle to either increase or lower the relative speed of printing.

The invention hereof reads the coil temperature in a shared memory through a program written to interpret the data. In effect, a count value is converted to voltage then to current and then to resistance. Inasmuch as resistance is a function of heat, the relative heat of the coils 74 can then be established from an initial calibration point. This prevents the thermal damage to the hammerbank by effectively measuring the change in current through a coil 74 or its associated voltage during a particular shuttle 10 or a hammerbank assembly 12 turnaround.

In order to provide the appropriate operation and coil protection, the invention hereof detects either a warm coil or a hot coil from a calibration point. If the printer detects a warm coil, the hammers will only print in a unidirectional movement of the shuttle 10. If a hot coil is detected a fault is declared and printing is stopped. It should be understood that relative values of hot and cold are established with respect to each printer coil 74 through an initial calibration process. This is based upon the fact that due to manufacturing characteristics, each coil 74 might have a different characteristic so that it must be calibrated before a relative value can be established as to warm or hot.

Initial calibration, assumes that generally 25° centigrade is a desirable operating condition at printer start up in an ambient environment of 25° centigrade. When the coil 74 is at 80° centigrade plus or minus 10° it is deemed to be warm. When it is at 100° centigrade plus or minus 10° it is deemed to be hot.

Another feature of this invention is that the coil test circuit allows a test to determine if there is an open coil or whether or not it is partially shorted. This serves to provide for diagnostics of the printing circuit so that various characteristics and functionality of the coil can be determined.

Simply stated coil temperature readings are based on a change in resistance of the copper of the coil 74 due to temperature changes. Given the length of a coil used herein, an increase in temperature from a calibrated temperature of 25° centigrade to 80° centigrade creates an increase in resistance of 21.4 percent. A change in temperature of the coil of 75° centigrade (i.e. from 25° to 100° centigrade) creates an increased resistance of 29.3 percent.

Each hammer coil 74 has approximately 4.350 ohms resistance. The flex circuit 32 resistance increases resistance from 0.45 to 0.93 ohms, while the ribbon cable 30 is approximately 0.8 ohms. Thus, the total resistance at 25° is approximately 5.6 to 6.1 ohms. Therefore, a change in the coil 74 resistance may be determined inasmuch as both flex circuit resistance and ribbon cable resistance remain relatively constant.

The coil test circuit of FIG. 8 showing its connected relationship to the mechanical processor 204 will be detailed after the procedure for the test as hereinafter set forth. This procedure will be viewed in the time line showings of FIGS. 6 and 7. The test is functionally that of a sequential test with regard to N coils 74 in this case coils 1 through 48 that are sequentially tested. Each coil fires one hammer or dot per coil. The current of that coil or voltage is checked, and the result, with a response based upon the result, allowing continued testing of that particular coil, or a test proceeding to the next coil.

In order to initialize the printer and provide for calibration, all the respective ambient temperatures of the coils are read and compared with known good ranges of values. If these ranges of the coils at ambient temperature appear to be correct, they are stored in a non-volatile memory (NVM) and used as a reference for subsequent monitoring of the coil resistance. This storage in the NVM can be within the mechanical processor or a separate circuit in conjunction with the coil test circuit of FIG. 8.

In order to initialize the calibration, there is an operator control on the printer to initialize coil resistance in the off line or cool mode. This coil resistance is identical with the test performed in the coil test initialization. Also, it should be noted that each coil is tested separately and sequentially and only one coil is tested for each stroke or direction of movement of the hammerbank 12.

Figure 6:
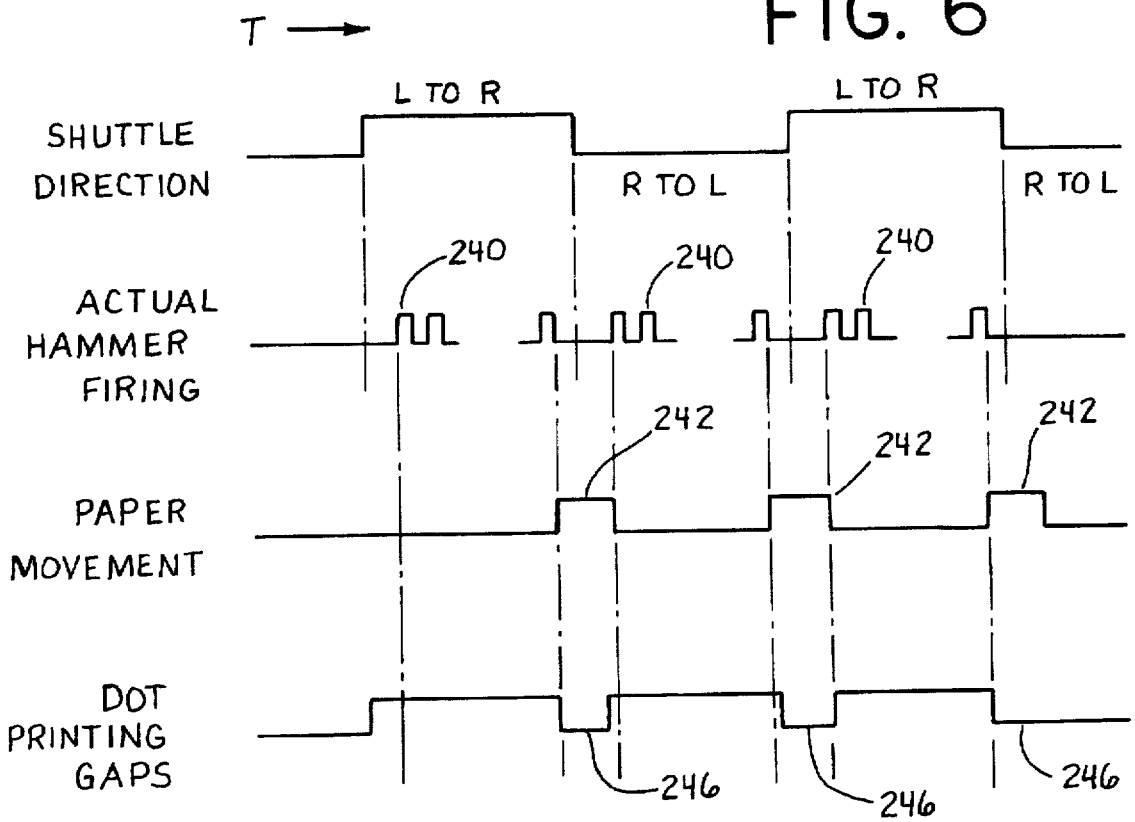
FIG. 6 shows a view of the coil testing scheme along a time line in the direction of arrow T.

In order to understand the test sequence more fully, FIG. 6 provides a time line sequence of tests in the direction of line T. The movement of the shuttle 10 with the hammerbank 12 in the form of the shuttle direction from left to right (L to R) and right to left (R to L) is shown. The shuttle direction of the hammerbank assembly 12 is such wherein it oscillates or reciprocates from L to R and then R to L. During these directional movements, it can be seen that actual hammer 56 firing is on the second line. Each respective firing 240 is representative of a dot being printed. The dots are being printed on a continuum through the L to R and R to L movement of the hammerbank assembly 12.

After movement of the shuttle 10 and hammerbank assembly 12, and at the time of shuttle reversal (i.e. L to R and R to L) movement of the paper across the face of the hammers 56 takes place. These movements can be seen as movements 242 along the paper movement line.

The allowable test time must be when the hammers are not firing and there is no printing of the dots. This is between printing of the dots after hammer firing 240, and at the time of hammerbank 12 reversal. This takes place in effect at the time that the hammerbank assembly 12 is preparing to be reversed and is then moving in the opposite direction, i.e. when it goes from L to R to R to L and back again to L to R. This particular allowable time for the coil test is shown as gaps 246 constituting no dot printing or movement of the hammers between firings 240 in the actual dot firing mode. In effect, the test is made during these time periods of when the hammerbank assembly 12 is going through the reversing mode in the opposite direction at which time the hammers 56 are not firing and the coil test can be undertaken at such time.

Figure 7:
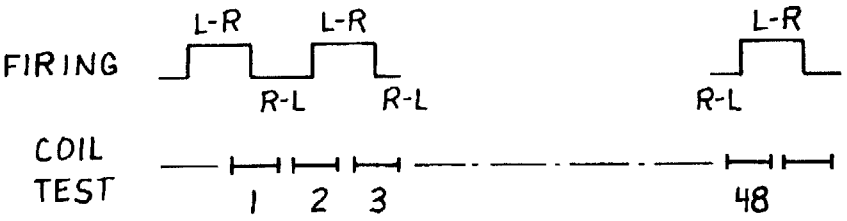
FIG. 7 shows the coil testing on a series of coils in the hammerbank along a time line T going from coils 1 through 48.

The method of the coil test can also be seen in FIG. 7 in the direction of time line T wherein the firing of the hammers 56 from left to right (L to R) and right to left (R to L) can be seen. The coil tests of the coils 1 through 48 are shown taking place through the time of reversal of the hammerbank 12 outside of the hammer firings 240.

Each coil 74 must be tested separately and sequentially and only 1 coil is tested during each reversing movement of the hammerbank assembly 12. In case a coil such as the coils as shown in FIGS. 6 and 7 are tested as being hot or warm, the test for the coil is repeated from the L to R and again from the R to L movement until it is either deemed to be warm at which time unidirectional printing takes place. If the coil is hot, the printer stops. Assuming all the coils 1 through 48 are tested sequentially as being not hot nor warm, the printer will continue to print in a multidirectional L to R and R to L manner. Should at any particular point in the L to R or the R to L reverse direction, a coil is deemed to be warm, the printer will only print in a unidirectional manner. In effect, if the test is made in between the L to R to the R to L direction, the printer will then only print in the R to L direction and skip the L to R direction until the coil has cooled down sufficiently to no longer be considered warm.

When testing the coils during the reversal of the hammerbank assembly 12, it can be seen that the test does not interfere with normal printing. The test is terminated before the start of a printing stroke of the hammers 56. The test is started immediately right after the last hammer firing when starting into the reversal mode.

When looking at FIG. 4, it can be seen that the hammerbank ASIC 100 and the hammer coil 74 with the upper drive connected thereto and the lower drive 102 provide for the function of constant printing.

In order to temperature test the coils through the aspects of the current which is a function of resistance and heat, the coil test circuit as connected to the mechanical processor 204 shown in FIG. 8. The coil test is performed by a mosfet 280 of the coil test circuit of FIG. 8 turning on at the reversal time 246 between hammer firings 240 so that the relative resistance as seen by the flyback current through resistor 282 is determined. This particular analog output is provided to integrated circuit (IC) 284 to provide an amplified analog output to comparitor 286 which compares the particular analog output with respect to a ramp value generated by ramp 288. The time interval from ramp start to ramp matching of the analog input is converted to a value representing temperature of the particular coil.

A comparison is then made with regard to the value stored at approximately 25° centigrade in the NVM. This provides for a given comparative value so that the functions of unidirectional printing or stopping of the printer can be provided for. It should be understood that if a fault is detected and the printer is stopped, there is no loss of print data from the host 200 and the data is maintained until it is to be printed thereafter.

To provide for the analog to digital conversion of the coil current, the coil 74 current should be stable for 1 msec after starting the test. About 800 usec into the test, a counter and ramp signal is provided from the ramp 288. The ramp signal should intersect the coil current output within 150 to 220 usec. In operation, the counter starts at 254 and counts down to zero. When the ramp signal from the ramp 288 crosses the coil current level, the counter is stopped. The final value of the counter is transmitted into the mechanical processor for processing to determine whether a value is determined as cool, warm or hot with respect to a particular coil 74.

A second coil test circuit is shown in FIG. 8*a*. The coil test is performed by a mosfet 280 of the coil test circuit of FIG. 8*a* turning on at the reversal time 246 between hammer firings 240 so that the relative resistance as seen by the flyback current through resistor 282 is determined. This particular analog output is provided to integrated circuit (IC) 284 to provide an amplified analog output to an analog to digital convertor (ADC) 287 which in turn provides a value representing temperature of the particular coil.

A comparison is then made with regard to the value stored at approximately 25° centigrade in the NVM. This provides for a given comparative value so that the functions of unidirectional printing or stopping of the printer can be provided for. It should be understood that if a fault is detected and the printer is stopped, there is no loss of print data from the host 200 and the data is maintained until it is to be printed thereafter.

To provide for the analog to digital conversion of the coil current, the coil 74 current should be stable for 1 msec after starting the test. About 800 usec into the test, the ADC 286 is enabled, and the resulting value is stored, and the comparison made.

In lieu of a determination of the current change by increased resistance, the voltage of a particular coil 74 being driven can be tested to determine relative resistance and attendant temperature. Numerous ways can accommodate a voltage coil 74 test using the upper and lower drive, or an alternative ground, or some other reference for the drivers 102. Also a separate voltage test across the coil 74 can be utilized to determine the particular coil's resistance and relative temperature. All the foregoing voltage tests to determine coil 74 resistance and attendant temperature can utilize the foregoing test and timing sequences during movement of the hammerbank 40 from L to R and R to L.

From the foregoing, it can be seen that a test of the coil 74 heat is provided on a sequential basis for every coil sequence at the end of the movement of the hammerbank assembly 12, on a basis which does not interfere with printing and at the same time provides a highly accurate test without the requirement of heat sensors in situ next to the coil or other means for detecting temperature, thereby being a substantial step in the art that should be read broadly in light of the following claims.

We claim:

1. A line printer for printing on a print media comprising:

a hammerbank driven for reciprocal movement having a plurality of hammers retained by means of a permanent magnet;

coils that are electrically driven for releasing said hammers from the magnetic field of said permanent magnet by an electrical drive circuit comprising at least one translator in association with each respective coil;

means to store a pre-established resistance equivalent to a pre-established first temperature of said coils;

a coil test circuit for determining the resistance with respect to the pre-established resistance of said coils during the period of reciprocation of the hammerbank after the last hammer firing for determining coil temperature with respect to the pre-established first temperature including transistor means that turn on at the time of reciprocation of the hammerbank to measure flyback current from said coils and, means for providing an output based on the resistance of the entire coil equivalent to the temperature of said coil, for controlling said coil.

2. The line printer as claimed in claim 1 further comprising:

said coil test circuit for determining the resistance of said coils comprises means for determining the voltage of said coil.

3. The line printer as claimed in claim 1 wherein:

said coil test circuit to determine resistance comprises means connected to said coils to determine the current flowing through said coils.

4. The line printer as claimed in claim 3 further comprising:

means for converting the current flowing through said coils to the resistance; and, means for comparing the resistance to a pre-established resistance.

5. The line printer as claimed in claim 2 wherein:

said voltage of said coils is compared to a pre-established voltage which is the voltage at initial start-up of said printer.

6. The line printer as claimed in claim 4 wherein:

each of said coils comprise two continuously connected portions that are respectively wrapped around two pole pieces.

7. A line printer lot printing data from a host comprising:

a hammerbank having a plurality of hammers which are retained by magnetism from a permanent magnet;

means to reciprocally drive said hammerbank across a print media:

at least one pole magnetically connected to said permanent magnet for retaining each of said hammers;

coil surrounding said pole pieces;

electronic drive means for providing a current through said coil for firing said hammers;

transistor means which turn on during reciprocation of said hammerbank;

means to provide a pre-established flyback current through said coil equivalent to a first coil temperature;

means to determine the flyback current through said entire coil after hammer firing with respect to said pre-established current after said transistor means turn on during reciprocation of said hammerbank to determine said coil temperature change with respect to said first coil temperature; and, means to drive said coil respect to said determined temperature change.

8. The printer as claimed in claim 7 wherein said electronic drive means comprise:

transistor means for selectively providing current to said coils.

9. The printer as claimed in claim 8 further comprising:

said means to determine current flow through a respective coil is converted to a temperature and compared to a pre-established temperature for said coil; and, means to provide for unidirectional printing when the temperature of said coil exceeds the pre-established temperature.

10. The printer as claimed in claim 8 further comprising:

said means to determine current flow through a respective coil is converted to a temperature of said coil, and compared to a pre-established temperature; and, means for inhibiting printing of said printer when said temperature exceeds said pre-established temperature.

11. The printer as claimed in claim 8 wherein:

said means to determine current flow comprises means to determine coil voltage.

12. The printer as claimed in claim 8 further comprising:

non-volatile memory means;

means to store a pre-established current flow through a particular coil in said non-volatile memory means; and, means to determine the flyback current in a digitized manner and compare it to said pre-established current within said non-volatile memory means.

13. A test circuit for determining the temperature in coils within a line printer wherein said line printer has a hammerbank capable of being driven for reciprocal movement with a plurality of hammers retained by permanent magnetism until released by energizing said coils in associated relationship with said hammers wherein the improvement comprises:

means to store a pre-established temperature of said coils based upon a first flow of current through said coils;

means for determining a second current flow through said coil in the entirety during operating conditions of said printer between hammer firings during reciprocation of said hammerbank;

means for comparing said first and second current flows to determine the difference between said current flows and the corresponding temperature change; and, means for controlling said printer with respect to said temperatures.

14. The printer as claimed in claim 13 further comprising:

means to store in a non-volatile memory said pre-established temperature; and, means for comparing said pre-established temperature in said non-volatile memory to coil operating temperature during reciprocating movement of said hammerbank.

15. A method of determining temperature of a coil in a hammerbank of a line printer comprising:

moving said hammerbank in a reciprocating manner;

providing a first coil resistance value based upon a pre-established temperature of said coil;

sensing a second coil resistance of said coil in the entirety during the operation of the hammerbank;

comparing said second coil resistance of said coil during operation with the first coil resistance;

controlling said printer with respect to the differential between said first and second coil resistances; and, driving the hammers of said hammerbank during a pre-established direction of movement for printing when said second resistance exceeds said first resistance by a pre-established amount.

16. The method as claimed in claim 15 further comprising:

sensing the second resistance of said coil during hammerbank reciprocation at a time between the last hammer of the hammerbank being fired up to the time of a hammer being fired during reverse movement.

17. The method as claimed in claim 16 further comprising:

sensing said second resistance of each respective coil sequentially.

18. The method as claimed in claim 15 wherein:

said coil resistances are sensed by determining current flow through said coil.

19. The method as claimed in claim 15 wherein:

said coil resistances are sensed by determining coil voltage.

* * * * *